United States Patent [19]

Lewis

[11] Patent Number: 4,457,828

[45] Date of Patent: Jul. 3, 1984

[54] MESOPHASE PITCH HAVING ELLIPSPIDAL MOLECULES AND METHOD FOR MAKING THE PITCH

[75] Inventor: Irwin C. Lewis, Strongville, Ohio

[73] Assignee: Union Carbide Corporation, Danbury, Conn.

[21] Appl. No.: 363,557

[22] Filed: Mar. 30, 1982

[51] Int. Cl.[3] ..... C10C 3/00; C09K 3/34; C07C 2/12

[52] U.S. Cl. ..... 585/11; 208/22; 208/44; 208/39; 585/422; 585/425; 528/396; 252/299.62; 423/447.4

[58] Field of Search ..... 208/22, 44, 39; 585/422, 425; 423/447.2, 447.4, 447.6; 528/396

[56] References Cited

U.S. PATENT DOCUMENTS

| | | | |
|---|---|---|---|
| 2,240,583 | 5/1941 | Sparks et al. | 528/396 |
| 3,373,101 | 3/1968 | Folkins et al. | 208/44 |
| 3,565,832 | 2/1971 | Bilow et al. | 528/396 |
| 3,578,611 | 5/1971 | Bilow et al. | 528/396 |
| 3,734,866 | 5/1973 | Aylies et al. | 528/396 |
| 3,839,190 | 10/1974 | Frese et al. | 208/44 |
| 4,146,576 | 3/1979 | Wyss | 423/447.4 |
| 4,303,631 | 12/1981 | Lewis et al. | 423/447.4 |
| 4,317,809 | 3/1982 | Lewis et al. | 423/447.1 |

FOREIGN PATENT DOCUMENTS

| | | | |
|---|---|---|---|
| 1470999 | 7/1961 | Fed. Rep. of Germany | 528/396 |
| 49-81664 | 7/1974 | Japan . | |
| 397699 | 8/1933 | United Kingdom | 208/44 |
| 419062 | 10/1934 | United Kingdom | 585/422 |
| 1356566 | 6/1974 | United Kingdom | 208/40 |
| 1356599 | 6/1974 | United Kingdom | 208/40 |

OTHER PUBLICATIONS

P. Kovacic et al, p-Polyphenyl from Benzene–Lewis Acid Catalyst–Oxidant, (1965) pp. 100–103, J. Org. Chem. vol. 30.

*Primary Examiner*—Delbert E. Gantz
*Assistant Examiner*—Helane E. Maull
*Attorney, Agent, or Firm*—David Fink

[57] ABSTRACT

A mesophase pitch having ellipsoidal molecules is produced by the polymerization reaction of an aromatic hydrocarbon containing at least two condensed rings in which the coupling polymerization constitutes at least 60% of the polymerization reactions.

12 Claims, No Drawings

MESOPHASE PITCH HAVING ELLIPSPIDAL MOLECULES AND METHOD FOR MAKING THE PITCH

The invention relates to novel mesophase pitch comprising ellipsoidal shaped molecules and the invention also relates to methods for producing the pitch.

It is well known that carbon fibers having excellent mechanical properties suitable for commercial exploitation can be produced from spinnable mesophase pitches. The mesophase pitch derived carbon fibers are light weight, strong, stiff, electrically conductive, and both chemically and thermally inert. The mesophase pitch derived carbon fibers perform well as reinforcements in composites and have found use in aerospace applications and quality sporting equipment.

Generally, carbon fibers have been primarily made commercially from three types of precursor materials: rayon, polyacrylonitrile (PAN), and pitch. The use of pitch as a precursor material is attractive economically.

Low cost carbon fibers produced from isotropic pitch exhibit little preferred molecular orientation and therefore have relatively poor mechanical properties.

In contrast, carbon fibers produced from mesophase pitch exhibit high preferred molecular orientation and excellent mechanical properties.

As used herein, the term "mesophase" is to be understood as used in the instant art and generally is synonymous with liquid crystal. That is, a state of matter which is intermediate between crystalline solids and normal liquid. Ordinarily, material in the mesophase state exhibits both anisotropic and liquid properties.

As used herein, the term "mesophase pitch" is a pitch containing more than about 40% by weight mesophase and is capable of forming a continuous anisotropic phase when dispersed by agitation or the like in accordance with the prior art.

A conventional method for preparing a mesophase pitch suitable for forming a highly oriented carbon fiber includes the step of subjecting a precursor pitch to a thermal treatment at a temperature greater than about 350° C. to effect thermal polymerization. This thermal process results in the polymerization of molecules to produce large molecular weight molecules capable of forming mesophase. The criteria for selecting a suitable precursor material for the conventional method is that the precursor pitch be capable of forming a mesophase pitch which under quiescent conditions has large coalesced mesophase domains. The domains of aligned molecules must be greater than about 200 microns. This criterion is set forth in the prior art and has been found to be essential for determining a spinnable mesophase pitch suitable for commercial operations.

A typical conventional method is carried out using reactors maintained at about 400° C. for from about 10 to about 20 hours. The properties of the final material can be controlled by the reaction temperature, thermal treatment time, and volatilization rates. The presence of the high molecular weight fraction results in a melting point of the mesophase pitch of at least about 300° C. An even higher temperature is needed to transform the mesophase pitch into fibers. The operation is termed "spinning" in the art.

The amount of mesophase in a pitch can be evaluated by known methods using polarized light microscopy. The presence of homogeneous bulk mesophase regions can be visually observed by polarized light microscopy, and quantitatively determined by published methods.

The polarized light microscopy can also be used to measure the average domain size of a mesophase pitch. For this purpose, the average distance between extinction lines is measured and defined as the average domain size. To some degree, domain size increases with temperature up to about coking temperature. As used herein, domain size is measured for samples quiescently heated without agitation to about 400° C.

Softening point or softening temperature of a pitch, is related to the molecular weight constitution of the pitch and the presence of a large amount of high molecular weight components generally tends to raise the softening temperature. It is a common practice in the art to characterize in part a mesophase pitch by its softening point. The softening point is generally used to determine suitable spinning temperatures. A spinning temperature is about 40° C. or more higher than the softening temperature.

Generally, there are several methods of determining the softening temperature and the temperatures measured by these different methods vary somewhat from each other.

Generally, the Mettler softening point procedure is widely accepted as the standard for evaluating a pitch. This procedure can be adapted for use on mesophase pitches.

The softening temperature of a mesophase pitch can also be determined by hot stage microscopy. In this method, the mesophase pitch is heated on a microscope hot stage under an inert atmosphere under polarized light. The temperature of the mesophase pitch is raised at a controlled rate and the temperature at which the mesophase pitch commences to deform is noted as softening temperature.

The conventional thermal polymerization process for producing mesophase pitch has several drawbacks. There is considerable cost for the energy to provide the heat over the extended period of time necessary to bring about the thermal polymerization. In addition, the choice of precursor materials is limited, particularly for commercial production.

The use of a novel thermal-pressure treatment is described in U.S. Pat. No. 4,317,809 to I. C. Lewis et al for enabling the use of some materials previously considered unsuitable for the production of mesophase pitches.

Recently, the entire thermal polymerization process has been avoided by the use of a solvent extraction process which can be carried out on a precursor pitch to obtain a mesophase pitch without any heating whatsoever. The solvent extraction process, however, has the limitation in that the precursor material must be a pitch which includes mesophase components. Generally, the solvent extraction process has yields of from 10% to 20% by weight. The yields, however, can be increased substantially to about 40% by weight or more by the use of a preliminary heat treatment.

The applicant realized that it would be advantageous to control the polymerization process in order to produce mesophase pitch in high yields from very low molecular weight precursor materials. According to the prior art, many of these precursor materials are entirely unsuitable for producing mesophase pitch. Moreover, even if mesophase pitch were produced from such precursor materials, then the carbon fibers derived from these mesophase pitches would have poor mechanical properties. Surprisingly, a novel mesophase pitch was discovered.

In the article, entitled "p-Polyphenyl from Benzene-Lewis Acid Catalyst-Oxidant. Reaction Scope and Investigation of the Benzene-Aluminun Chloride-Cupric Chloride System" by Peter Kovacic and James Oziomek, J. Org. Chem., Vol. 29 pp. 100–103 (1965), a weak Lewis acid catalyst-oxidant comprising $AlCl_3$ and $CuCl_2$ is used to prepare polyphenyl polymers from benzene. The polymerization takes place through the formation of connecting single bonds between benzene molecules. This type of polymerization occurs without condensation. The polyphenyl polymers produced according to this article are infusible and do not melt when carbonized. Such materials are unsuitable for producing mesophase pitch acording to the prior art. Other forms of polyphenyl polymers have been prepared by other methods and are capable of producing a glassy carbon.

As used herewith, the term "couple" or "coupling" in connection with polymerization shall mean the formation of a single bond between two reacting molecules and a molecular chain having such bonds, can include more than two starting molecules.

Japanese Patent Application No. 81664-1974 relates to a method of manufacturing modified pitch and/or carbon using a molten salt system containing a strong Lewis acid and a non-reactive alkali halide to treat a selected material such as pitch. The Japanese Application relies on the use of an ionic medium in which polymerization is achieved by the stong Lewis acid with the second component establishing a eutectic solution having a relatively low melting point. It is a requirement that the second component combine only physically with the strong Lewis acid and that it does not form a chemical complex with the strong Lewis acid. The process of the Japanese Application effects aromatic condensation and thereby leads to the formation of discotic molecules. The mesophase pitch produced by thermal polymerization is also known to consist of discotic molecules.

As used herein, the term "condensation" as used in connection with polymerization between aromatic molecules is characterized by the establishment of at least two new bonds between the co-reacting molecules. This reaction, of course, is contrasted to coupling polymerization in which only single bonds are formed between co-reacting molecules.

The instant invention features a mesophase pitch having ellipsoidal molecules and possessing properties different and advantageous with respect to prior art mesophase pitches. In addition, the present invention relates to novel methods for producing mesophase pitch.

As used herein, "ellipsoidal" refers to the general shape of a molecule having an approximately elliptical cross section in the plane of the molecule with an aspect ratio greater than 1:1, preferably greater than 2:1.

The mesophase pitch of the invention is a mesophase pitch produced by the polymerization of an aromatic pitch in which the coupling polymerization constitutes at least 60% of the polymerization reaction.

The instant process invention in its broadest embodiment relates to the method for producing a mesophase pitch comprising a polymerization rection of an aromatic hydrocarbon containing at least two condensed rings to produce a mesophase pitch for which 60% of the polymerization reactions are coupling polymerizations.

The instant process invention relates to the use of a mild Lewis acid for achieving polymerization which favors coupling polymerization and enables the use of relatively low temperatures for the reactants. The weak Lewis acid is anhydrous $AlCl_3$ along with a moderating component. The second component must be a weaker acid such as anhydrous $CuCl_2$, $ZnCl_2$, $SnCl_2$, or the like in order to reduce the activity of the $AlCl_3$, and a solvent such as o-dichlorobenzene can be used. The second component can be pyridine hydrochloride which serves a dual function as both a weaker acid which reduces the activity of the $AlCl_3$ and also is a suitable solvent when molten.

The precursor material for the process must be an aromatic hydrocarbon containing at least two condensed rings and can be a low molecular weight species which graphitizes poorly. Moreover, the instant process invention enables the formation of spinnable mesophase pitch from precursor materials which can not be used in any prior art process. The suitable precursor materials include pitches and other known materials used in the production of mesophase pitch.

A surprising aspect of the instant invention is that very high yields are possible. The yield basically depends upon the recovery steps taken and in general, yields of 80% to 90% by weight can reasonably be expected for the process.

The amount of mesophase pitch formed during the process according to the invention depends upon the activity of the Lewis acid, the reaction temperature, the reaction time, and the precursor material. The relationship between these various factors can be determined experimentally in accordance with the teachings herein.

It can be understood that it may not be economically advisable to endeavor to obtain a high yield. The choice of the recovery steps as well as the extent of the mesophase pitch formation can be selected to optimize the cost and convenience for carrying out the instant invention.

The mesophase pitch according to the invention includes a mixture of both discotic molecules and ellipsoidal molecules. This mixture of molecular shape is evidenced in part by the mesophase pitch according to invention being miscible and homogeneous with both rod-like and discotic nematic liquid crystals. This is a surprising and unique property of the instant mesophase pitch.

The X-ray properties of the instant mesophase pitch are also unique. For a mesophase pitch having about 100% by weight mesophase, the stack height (Lc) is from about 20Å to about 25Å, preferably about 20Å, even though the interlayer spacing (co/2) is about 3.50Å or less. This interlayer spacing is typical for conventional mesophase pitch. In contrast, the stack height for conventional mesophase pitch is greater than 25Å and usually greater than 35Å.

The process according to the invention results in a mesophase pitch having a mesophase content as high as 100% by weight and yet the softening point is considerably lower than comparable mesophase pitch produced by themal polymerization. Generally the softening point is from 50° to 100° lower. A low softening point enables spinning operations to be at a relatively low temperature so that there is a reduced energy cost for the production of carbon fibers. The low melting point also minimizes the possibility for a thermal reaction during spinning and the formation of gases and high viscosity products. For certain purposes, it may be preferable to have a higher softening point. The softening point can be raised by reacting additionally and/or by distillation.

Another aspect of the instant invention is the formation of mesophase pitch using a combination of the instant process along with either solvent extraction or thermal polymerization. A precursor material can be transformed into a form which appears isotropic even though it contains mesophase components. A subsequent operation can be used to produce a mesophase pitch having a predetermined mesophase content. A two stage operation of this type may have attractive commercial value. Terminating the first stage even before the apparent formation of mesophase results in a material which will have little or no incidental formation of insoluble components or at least will be suitable for a filtering step to remove insolubles.

A preferred embodiment of the instant process comprises the steps of subjecting an aromatic hydrocarbon containing at least two condensed rings to a reaction in the presence of a mixture of about two parts $AlCl_2$ and about one part pyridine HCl at a temperature of from about 100° C. to about 250° C. This embodiment results in a mesophase pitch which is generally composed of mesophase molecules which are discotic rather than being ellipsoidal unless the operating conditions are adjusted carefully.

Another embodiment of the process uses $AlCl_3$ and $CuCl_2$ along with a solvent as o-dichlorobenzene. Preferably, the mole ratio of the respective components $AlCl_3$, $CuCl_2$, and precursor material is about 1:1:2 to about 1:1:1. Preferably, the reaction is carried out at a temperature from about 100° C. to about 180° C. for a time of from about two hours to about 20 hours.

The solvent for the polymerization with $AlCl_3$ and the second component such as $CuCl_2$, is preferably aromatic, must be non-reactive with the weak Lewis acid, must be polar, have a boiling point higher than about 100° C., and must be a solvent for the precursor material. Instead of o-dichlorobenzene, nitrobenzene, trichlorobenzene, and the like can be used.

After the reaction has reached the point desired, the reactants are cooled and the solid portion is recovered. The solvent can be removed by distillation. The undesirable inorganic compounds can be removed by hydrolyzing and dissolving them with HCl and the like, followed by filtering.

The reaction time as well as the reaction temperature can be determined experimentally for the selected precursor material in order to achieve a predetermined mesophase content or at least react the precursor material to a predetermined point suitable for subsequent steps for producing mesophase pitch.

One of the drawbacks in the prior art has been the use of a chemical process for producing mesophase pitch using a strong Lewis acid so that the mesophase pitch produced was discotic and did not possess the unique properties of the instant mesophase pitch.

One of the surprising properties of the instant mesophase pitch is uniquely related to the ellipsoidal molecules. It is known that conventional discotic mesophase pitch produces carbon fibers which exhibit non-linear stress-strain behavior along with a relatively low compressive strength when compared to PAN-derived carbon fibers. A theoretical analysis indicates that these two problems with conventional carbon fibers are due to the graphitic character or large crystallite size of the carbon fiber structure. A high degree of alignment of graphitic layers parallel to the fiber axis is necessary for achieving a high Young's modulus and a high tensile strength. A high degree of misalignment of the layers, i.e., randomness of orientation as viewed in the transverse cross section is desirable to enhance axial compressive properties. Thus, it is evident that graphite-like crystallites which are elongated in the fiber axis direction and relatively narrow and thin in the transverse direction would result in improved compressive strength.

It can be expected that during the spinning of pitch fibers from the instant mesophase pitch the ellipsoidal molecules will tend to align themselves with the larger axis of the molecules generally parallel to the fiber axis. The resulting carbon fiber is expected to possess improved mechanical properties and provide new commercial uses for carbon fibers produced from the instant mesophase pitch because of the improved compressive strength.

Further objects and advantages of the invention will be set forth in part in the following specification and in part will be obvious therefrom without being specifically referred to, the same being realized and attained as pointed out in the claims thereof.

The illustrative, non-limiting examples of the practice of the invention are set out below. Numerous other examples can readily be evolved in the light of the guiding principles and teachings contained herein. Examples given herein are intended to illustrate the invention and not in any sense to limit the manner in which the invention can be practiced. The parts and percentages recited herein, unless specifically stated otherwise, refer to parts by weight and percentages by weight.

EXAMPLE 1

In order to establish a guideline for practicing the invention, the following test was carried out. Five grams of 1,1'-binaphthyl was reacted with six grams of anhydrous $CuCl_2$ and six grams of anhydrous $AlCl_3$ in 75 milliliters of o-dichlorobenzene for one hour at about 80° C. The reaction was carried out in a round bottomed flask having a 100 milliliter capacity and fed with a reflux condensor. Nitrogen was passed over the reactants for about one half hour at a slow rate to exclude air. The mixuture was stirred with a magnetic stirrer during the reaction.

After cooling, the reactants were poured into 100 milliliters of dilute hydrochloric acid at about 0° C. and then stirred for about a half hour in order to dissolve copper and aluminum salts. The hydrochloric acid solute was decanted and the residual organic liquid and solid was treated twice more with hydrochloric acid. After the removal of the last hydrochloric acid treatment, ethanol was added to the reactants to precipitate an organic material from the solution in order to increase the yield. The entire mixture was then filtered to obtain a dark solid. This solid was washed with dilute hydrochloric acid and then with water. After drying at 70° C. in a vacuum oven, 4.1 grams of solid remained and this amounted to about 82% by weight yield.

The solid was heated on a hot stage microscope and melted at a temperature above about 250° C. The solid formed a totally isotropic liquid.

No mesophase was observed even when the temperature was raised to about 400° C.

The solid was analyzed by field desorption mass spectroscopy which showed that the solid was composed mainly of binaphthyl dimers with molecular weights of 506 and 504. Smaller amounts of binaphthyl tetramers with molecular weights of 1,008, 1,006 and 1,004 were also present. For the dimers, the degree of condensation was 0/2 and 1/2 while for the tetramers the degrees of condensation were 1/7, 2/7, and 3/7.

In order to illustrate the effect temperature and time have on the instant process, the foregoing test was repeated except that the reaction temperature was maintained at about 125° C. for about two hours.

The reaction mixture was then cooled and added to 175 milliliters of concentrated hydrochloric acid and stirred for one hour in the acid. The mixture was filtered and the solid residue was washed again with 200 milliliters of concentrated hydrochloric acid. After filtration and drying it was determined that a 73% by weight yield was obtained. No particular effort was made to maximize the yield as in the first test.

The solid produced was heated on a microscope hot stage and melted at above about 350° C. to produce a 100% anisotropic liquid phase.

A field desorption mass spectroscopy showed that the product contained mostly binaphthyl trimers. Most of the molecular weights were about 754, 756, and 752. This implies that coupling polymerization dominated because the molecules were primarily either partially condensed or not condensed. The molecules had ellipsoidal configurations. The degrees of condensation were 1/5, 2/5 and 3/5.

These tests show that the reaction conditions for 1,1'-binaphthyl should be selected to produce at least trimers in order to form mesophase. This principle can be generalized for precursor materials containing up to about four condensed ring systems. The reaction conditions depend upon temperature, the Lewis acid, and reaction time.

In contrast, if the same binaphthyl had been subiected to conventional thermal polymerization, it would have distilled off prior to reacting and no mesophase would have been formed.

EXAMPLE 2

A mixture of 5 grams of 2,2' binaphthyl, 6 grams of anhydrous $AlCl_3$, and 6 grams of anhydrous $CuCl_2$ was stirred into 75 milliliters of o-dichlorobenzene at 80° C. for one hour under a nitrogen atmosphere. The reactants were cooled and recovered using hydrolysis and filtration as in the Example 1. A 82% by weight yield of a pitch-like product was obtained. This product was heated on a microscope hot stage and it melted at a temperature above about 230° C. to produce an isotropic liquid phase. That is no anisotropic phase was observable.

The foregoing test was repeated using 3 grams of 2,2' binaphthyl, 3.8 grams of anhydrous $AlCl_3$, and 3.8 grams of anhydrous $CuCl_2$ in 70 milliliters of o-dichlorobenzene. The reaction was carried out at a temperature of about 100° C. for about two hours and then the same hydrolysis and filtration steps were carried out. A yield of about 100% by weight was obtained and heated on a microsope hot stage. The softening point was at about 325° C. and the product contained from 80% to about 90% by weight mesophase.

A portion of this product was examined using the field desorption mass spectometry to determine its molecular weight composition. The major component was a dimer having a molecular weight of 504 which contained 4 naphthalene units linked by single aryl-aryl bonds and with one pair of napthalene units being condensed. The degree of condensation was 1/3.

The remaining components include perylene having a molecular weight of about 252 and polymers containing 3, 5, 6, and 7 naphthalene units. The trimers were fully condensed while the pentamers having molecular weights of 628 and 630 exhibited states of condensation of 1/4 and 2/4 respectively. The hexamers having molecular weights of 752 and 754 had states of condensation of 2/10 and 4/10 respectively while the heptamers had no condensed napthalene units.

EXAMPLE 3

A mixture of 5 grams of naphthalene, 5 grams of pyrene, 5 grams of anhydrous $AlCl_3$, and 5 grams of anhydrous $CuCl_2$ was added to 70 milliliters of o-dichlorobenzene in a 250 milliliter flask fitted with a reflux condensor. The mixture was heated to about 180° C., boiling temperature, and stirred. The heating was continued under reflux condition for a period of about 17 hours. After cooling, the mixture was poured into 100 milliliters of concentrated hydrochloric acid and stirred for two hours. The product was filtered and the solid which was recovered was ground to a powder and retreated with 200 milliliters of hydrochloric acid for two hours. After filtration, the solid was dried under a vacuum at a temperature of about 110° C. About 5.5 grams were recovered and this amounted to about 55% by weight yield. A higher yield could have been obtained but no effort was made to improve the yield.

In accordance with conventional test procedures, a portion of the solid was annealed in a ceramic boat at a temperature of about 400° C. for about a half hour and the annealed solid was then potted in epoxy. Examination by polarized light microscopy indicated that the solid contained about 100% by weight mesophase. It is evident that a higher yield would have reduced the mesophase weight percentage because the additional solid probably had a lower molecular weight as indicated by its solubility.

EXAMPLE 4

The process as generally set forth in the foregoing examples was carried out using 10 grams of a coat tar pitch having a softening point of about 125° C., 5 grams of anhydrous $AlCl_3$, and 5 grams of anhydrous $CuCl_2$ and 70 milliliters of o-dichlorobenzene. The reaction mixture was heated for five hours at a temperature of about 150° C.

The reactants were cooled and recovered by the hydrolysis and filtration steps. The yield was 8.2 grams or 82% by weight of a pitch. The steps of Example 3 of annealing and examining by polarized light microscopy showed that the pitch contained about 60% by weight mesophase.

EXAMPLE 5

The process as set forth in the foregoing examples was carried out for a petroleum pitch having a softening point of about 125° C. 10 grams of the pitch, 5 grams of anhydrous $CuCl_2$, and 5 grams of anhydrous $AlCl_3$ were reacted in 70 milliliters of o-dichlorobenzene. The reaction mixture was heated for 16 hours at a temperature of about 150° C.

After the treatment, the recovery steps were carried out to obtain a pitch having a yield of about 100% by weight.

The pitch was evaluated and found to contain about 70% by weight mesophase and exhibited domains on the order of several hundred microns.

EXAMPLE 6

The process of the invention was carried out using a mixture of 5 grams of napthalene and 5 grams of phenanthrene. This mixture was combined with 10 grams of anhydrous $AlCl_3$ and 10 grams of anhydrous $CuCl_2$ in 70 milliliters of o-dichlorobenzene. The reaction mixture was heated for 13 hours at about 180° C. The recovery steps resulted in a yield of about 47% by weight. No particular effort was made to maximize the yield. The pitch obtained had a mesophase content of about 95% by weight.

For comparison purposes, the foregoing test was repeated except that half the amounts of $AlCl_3$ and $CuCl_2$ were used. The pitch obtained contained only about 5% by weight mesophase.

EXAMPLE 7

A mixture of 5 grams of naphthalene and 5 grams of phenanthrene was treated with 5 grams of anhydrous $AlCl_3$ and 5 grams of anhydrous $CuCl_2$ in 70 milliliters of o-dichlorobenzene for a period of 52 hours at about 180° C. The recovering steps of hydrolysis and filtration resulted in a yield of about 90% by weight and measurements indicated that the mesophase content was about 95% by weight.

EXAMPLE 8

A mixture of 45 grams of naphthalene, 45 grams of phenanthrene, 45 grams of anhydrous $AlCl_3$, and 45 grams of anhydrous $CuCl_2$ was heated to a temperature of about 180° C. with 250 milliliters of o-dichlorobenzene for 26 hours. The solvent was then removed by distillation under a nitrogen atmosphere. The solid residue was hydrolyzed by treatment with water and concentrated hydrochloric acid. The solid product obtained was melted and stirred under a nitrogen atmosphere at a temperature of 380° C. for one hour in order to remove residual solvent. The yield was about 82% by weight, or about 73.8 grams, and has a melting point of about 170° C. This product contained about 10% by weight mesophase in the form of small spheres.

A portion of this material was examined by field desorption mass spectrometry and shown to be a complex mixture of molecules having molecular weights in the range of from about 300 to about 1,000. The spectra indicated that the main components were polymers of naphthalene and phenanthrene containing up to 10 monomers units. From the molecular weight data, it can be determined that the degree of condensation was low and that less than 60% of the total bonding sites had been utilized.

This pitch was heat treated at 390° C. for 4 hours while being sparged with nitrogen at the rate of $1.3\times10^{-4}$ standard cubic meters per second per kilogram. The product obtained amounted to a 74% by weight yield with respect to the starting material and had a Mettler softening point of 236° C. A portion of this pitch was melted at a temperature of 350° C. for a half hour. An examination using polarized light microscopy indicated a mesophase content of 100% by weight and domains greater than about 500 microns. An anlaysis of the volatiles indicated that the volatiles contained primarily dimers. Thus, it was necessary to remove the dimers by sparging in order to allow mesophase formation.

The mesophase pitch exhibited excellent spinnability and was spun at the surprisingly low temperature of about 265° C. into monofilaments having diameters of about 10 microns. The as-spun fibers were examined under polarized light microscopy and were anisotropic with large domains.

X-ray measurements were carried out on the as-spun fibers. The interlayer spacing ($C_o/2$) was measured to be 3.49 Å and the stacking height ($L_c$) was measured to be 20.6 Å. The conventional discotic mesophase pitch typically has about the same interlayer space and a stacking height greater than about 35 Å. The relatively low stacking height of the instant mesophase pitch, despite the 100% by weight mesophase content, tends to confirm that the moleules are ellipsoidal with a large aspect ratio so that the relative alignment in the direction of the stacking height is relatively small even though the pitch is anisotropic.

The as-spun fibers were thermoset or infusibilized. The thermoset fibers were then carbonized in accordance with conventional practice to 2,500° C. in an inert atmosphere. The carbon fiber obtained had a Young's modulus of about 517 GPa and a tensile strength of about 1.61 GPa.

A portion of the pitch containing 10% by weight mesophase was heat treated in a small ceramic boat under nitrogen at about 400° C. for 6 hours. The product contained about 90% to 95% mesophase in the form of spheres and coalesced domains. Nearly all of the spheres exhibited extinction crosses which were independent of stage rotation on the polarized light microscope. Using sensitive tint, it was found that the spheres gave an opposite color configuration as compared to mesophase spheres found in conventional mesophase pitch. These results indicate that the spheres of the mesophase pitch of this example have a novel symmetric structure as compared to the thermally produced mesophase pitch.

An analysis of the product obtained from the polymerization according to the invention indicated that small amounts of infusible solids were present and these were copper-containing particles which were not removed by the acid hydrolysis. One of the advantages of the products produced by the instant process is that the low softening point and viscosity of the mesophase pitch enables the removal of these solids by melt filtration at a temperature below which further reactions occur. In contrast, the melt filtration of a conventional mesophase pitch must be carried out at a relatively high temperature for which it is possible for undesirable polymerization to occur. The presence of particles has an adverse effect on the fibers spun from the pitch containing these particles.

A portion of the mesophase pitch of the example was filtered through porous stainless steel filter having 10 micron pores packed with diatomaceous earth. The filtration was carried out in a heated pressurized vessel using nitrogen at a pressure of 345 KPa to 517 KPa at a temperature of about 300° C. A nonreacting atmosphere is needed during the filtration to prevent oxidation of the pitch. After the filtration, the mesophase pitch was spun into monofilaments at a temperature of about 272° C. The filaments had a diameter of about 10 microns. The filaments were carefully thermoset. The low softening point of the as-spun fibers requires particular care during the thermosetting in order to avoid melting the pitch fibers and thereby interfering with the orientation of the molecules. The thermoset fibers were carbonized to about 2500° C. in an inert atmosphere according to conventional practice.

The carbon fiber obtained had a Young's modulus of about 379 GPa and an average tensile strength of about 2.51 GPa. It is interesting that some of the fibers possessed much higher tensile strength, as high as 3.58 GPa. These high values for tensile strength indicate the improvement obtained by carrying out melt filtration to remove infusible solids.

As a further test, 50 grams of a naphthalenephenanthrene pitch produced by the reaction with $AlCl_3$ and $CuCl_2$ in o-dichlorobenzene according to this example was subjected to a reaction for 52 hours instead of 26 hours. A 90% by weight yield was obtained and the product contained about 100% by weight mesophase. No additional heat treatment was necessary as in the case when the reaction was for 26 hours. This mesophase pitch had a softening point of about 350° C. This is a high softening point for a mesophase pitch produced by the instant process and is due to the prolonged reaction time. This softening point is about the same as the typical thermally produced mesophase pitch having a high mesophase content.

This example illustrates that the mesophase content can be predetermined by trial and error by varying the reaction time for the process according to the invention. Accordingly, one can obtain a mesophase pitch having a relatively low softening point by terminating the chemical polymerization according to the invention at a point when the mesophase content is relatively low, such as in the range of 10% to 20% by weight and thereafter, the mesophase content can be increased by the use of a thermal polymerization, preferably including sparging in accordance with known methods. The thermal polymerization required is considerably less than the amount needed for the conventional process using an isotropic pitch as a precursor material.

The initial pitch from the reaction according to the invention may only need sparging without thermal polymerization in order to remove low molecular weight molecules to obtain a high mesophase content.

The initial pitch of this example was transformed easily into a relatively high mesophase content despite the measured presence of only about 10% by weight mesophase. The high mesophase content in the inital pitch is not evident due to the presence of lower weight molecules which inhibited the appearance of mesophase during the classic measurements using hot stage polarized microscopy or the like.

EXAMPLE 9

A reaction according to the invention was carried out using 50 grams of naphthalene, 50 grams of phenanthrene, 50 grams of anhydrous $AlCl_3$, 50 grams of anhydrous $CuCl_2$, and 250 milliliters of o-dichlorobenzene. The reaction was carried out at about 180° C. for 26 hours and a solid residue was recovered using the steps set forth in Example 8. The yield was about 95% by weight. This is somewhat greater than the yield obtained in Example 8 for the same reaction conditions. The pitch obtained was subjected to melt filtration at a temperature of about 350° C. to remove inorganic solids. The product obtained amounted to 72% by weight yield and contained about 85% by weight mesophase. The softening point was about 225° C. The heat treatment and the sparging was then continued at a temperature of about 390° C. for another 3.5 hours and the yield was about 97% by weight. The mesophase content was 100% by weight and the softening point was 236° C. The heat treatment was again resumed for 4 additional hours at a temperature of about 400° C. and gave a 95% by weight yield of a product having a softening point of about 245° C. This is surprising in that the softening point after the additional heat treatment did not increase substantially. Another heat treatment was carried out at a temperature of about 430° C. and the softening point increased to only 278° C. Each of the products after the initial heat treatment contained about 100% mesophase.

In contrast, a mesophase pitch heat treated in accordance with the foregoing would have resulted in the softening point being raised to 400° C., too high for spinning commercially.

A portion of the mesophase pitch having a softening point of 236° C. was spun into 10 micron fibers at a spinning temperature of 270° C. Not only is this a surprisingly low spinning temperature, but the pitch exhibited excellent spinnability. The as-spun fibers has a preferred orientation of about 35°. The fibers were carefully thermoset in ozone at a temperature of about 90° C. for 90 minutes and then heat treated in air at a temperature from about 260° C. to 360° C. The thermoset fibers were carbonized to a temperature of 2,400° C. in accordance with conventional practice. The Young's modulus was about 483 GPa and the tensile strength was about 1.24 GPa.

EXAMPLE 10

A pitch was prepared from naphthalene and phenanthrene by carrying out the reaction of example 9 with $AlCl_3$, $CuCl_2$ and o-dichlorobenzene. The product recovered was subjected to a molecular weight analysis by size exclusion chromatography. This analysis showed that the product contained phenanthrene, dimers, trimers, tetramers, pentamers, and hexamers of the precursor materials along with smaller amounts of high polymers.

The pitch was heated for 4 hours at a temperature of about 390° C. while being sparged with nitrogen at the rate of $1.3\times10^{-4}$ standard cubic meters per kilogram. The amount obtained amounted to a 70% by weight yield and contained about 85% by weight mesophase. The softening point was about 234° C. A molecular weight analysis showed that the pitch exhibited a unimodal distribution. That is, the molecular weight distribution had a single major maximum. This implies that the free phenanthrene and nearly all of the dimers had been removed during the sparging process. An analysis of data indicates that hardly any thermal polymerization occurred during this last heat treatment.

Therefore, the increased mesophase content present in the pitch after sparging as compared to the pitch obtained from the chemical polymerization is due to the removal of low weight molecules. This is surprising considering that the chemical polymerization as indicated in example 9 resulted in 10% mesophase and after sparging the mesophase content increased to 85%.

EXAMPLE 11

The invention in its broadcast scope includes the process of a polymerization reaction of an aromatic hydrocarbon containing at least two condensed rings to produce a mesophase pitch with anhydrous $AlCl_3$ and an acid salt of an organic amine. The acid salt must reduce the activity of the $AlCl_3$, be miscible with the $AlCl_3$ to form a molten eutectic salt mixture (lower melting point than either component), and bring about the polymerization reaction of the invention.

This embodiment is the subject of a concurrently filed patent application and the example given herein is a preferred mode of the instant invention process although the mesophase pitch produced does not tend to contain ellipsoidal molecules having relatively high length to width ratios, A pitch was prepared from 100 grams of naphthalene by reacting it with 50 grams of anhydrous $AlCl_3$ and 25 grams of pyridine hydrochloride at a temperature of about 150° C. for about 25 hours. The product was hydrolyzed with concentrated hydrochloric acid and the mixture was filtered by vacuum filtration. After washing and drying, a pitch was obtained. The pitch was a 96% by weight yield and contained only a few percent of mesophase.

The pitch was subjected to sparging at about 400° C. for about 18 hours to produce a mesophase pitch having a mesophase content of about 80% by weight and having a softening point of about 230° C. This mesophase pitch was a 60% yield.

EXAMPLES 12, 13, 14, 15 and 16

Blending experiments were carried out to demonstrate the surprising compatibility of the instant mesophase pitch having a mesophase content of about 100% mesophase with both discotic and rod-like liquid crystal compounds, as well as a cholesteric compound.

For Example 12, the mesophase pitch of Example 10 having a softening point of about 278° C. was mixed in a 1:1 ratio with a conventional mesophase pitch produced by thermally polymerizing a petroleum pitch. The conventional mesophase pitch had a mesophase content of at least about 95% by weight. The blend was annealed in a ceramic boat at about 350° C. for about ½ hour under nitrogen.

After cooling, the blend was examined by standard polarized light microscopy on epoxy-encapsulated mounts. The blend was a uniform mesophase composition having a mesophase content of at least about 95% weight. This showed that complete mixing had occurred.

For Example 13, the naphthalene-phenanthrene mesophase pitch of Example 9 having a softening point of 236° C. was mixed with 2% by weight of cholestreryl acetate and annealed at about 350° C. for about ½ hour. An examination of the mixture at 300° C. on a hot stage microscope showed that the entire mixture became a cholesteric liquid crystal. Additionally, a portion of the blend was annealed at about 350° C. for about ½ hour and examined by polarized light microscopy at room temperature. The blend was 100% by weight mesophase and exhibited a pronounced cholesteric structure. It is well known that prior art mesophase pitches are nematic liquid crystals and no cholestreric mesophase pitch has been reported in the prior art. This new mesophase pitch is the subject of a concurrently filed patent application and is a surprising blending property of the mesophase pitch of the invention.

For a comparison, 2% by weight of cholesteryl acetate was mixed with the conventional mesophase pitch of Example 12. No conversion to a cholesteric liquid crystal took place for the mixture and the mesophase content was reduced from 100% by weight apparently due to the cholesteryl acetate dissolving some of the pitch and converting it to an isotropic phase.

For Example 14, the naphthalene-phenanthrene mesophase pitch of Example 13 was mixed with 15% by weight of p-quinquephenyl. This compound contains rod-like molecules and melts at about 380° C. to form a nematic liquid crystal. The mixture was melted on a microscope hot stage at about 400° C. and formed a uniform anisotropic phase. The two components were compatible with each other and no separation was observed even on cooling to 25° C.

For comparison, the p-quinquephenyl was mixed with the conventional mesophase pitch of Example 12 as in the foregoing and this compound separated out both in the melt and at room temperature. Furthermore, the mixture showed 15% isotropic phase.

For Example 15, the naphthalene-phenanthrene mesophase pitch of Example 13 was mixed with 15% by weight 4,4' azoxydianisole. This compound is a rod-like nematic liquid crystal which forms a nematic phase at 133° C. The mixture at 350° C. on a microscope hot stage was a completely anisotropic phase without any separation of the components.

For Example 16, the naphthalene-phenanthrene mesophase pitch of Example 13 was mixed with 15% by weight p-methoxycinnamic acid. This compound melts from a solid crystal to a nematic crystal at 171° C. and converts to an isotropic phase at 189° C. The mixture was melted on a microscope hot stage, cooled, and then reheated at a temperature above about 260° C., the mixture appeared to be essentially a 100% by weight large domained mesophase. Below this temperature, large regions of both isotropic phase and solid crystalline phase were observed. The p-methyoxycinnamic acid is apparently compatible in liquid crystal form in the molten mesophase pitch and apparently separate out during cooling. Such a phenomenon, of gross conversion of isotropic phase to anisotropic phase on heating has not been reported in the prior art.

Conventional mesophase pitch was used in a similar test and no compatibility was evident at all.

It can be concluded from Examples 12, 13, 14, 15, and 16 that the instant mesophase pitch is unique and that it is characterized by its compatibility with both rod-like and discotic liquid crystals. Moreover, this property can be utilized as a criterion for identifying the instant mesophase pitch having about 100% by weight mesophase on the basis of mixing compatibility with about 100% by weight of rod-like and discotic liquid crystals.

EXAMPLE 17

In addition to the X-ray measurements given in Example 8, X-ray measurements were made on the mesophase pitches of Examples 3 and 5. Table 1 presents this data along with the typical data for a conventional thermally produced mesophase pitch.

TABLE 1

| Mesophase Pitch | Mesophase Content | Lc, Å | Co/2, Å |
|---|---|---|---|
| Example 3 | 100% | 20 | 3.53 |
| Example 5 | 70% | 20 | 3.51 |
| Example 8 | 100% | 20 | 3.49 |
| Thermally Produced | 100% | 35 | 3.50 |

Table 1 shows the surprising difference in Lc for the mesophase pitch of the invention as compared to the prior art mesophase pitch.

I wish it to be understood that I do not desire to be limited to the exact details as described, for obvious modifications will occur to a person skilled in the art.

Having described the invention, what I claim as new and desire to be secured by Letters Patent, is as follows:

1. A mesophase pitch produced by the polymerization of an aromatic hydrocarbon containing at least two condensed rings in which the coupling polymerization constitutes at least 60% of the polymerization reactions, said polymerization being carried out with a weak Lewis acid and a polar solvent for said aromatic hydrocarbon, said solvent being non-reactive with said Lewis acid.

2. A method for producing a mesophase pitch consisting essentially of a polymerization reaction of an aromatic hydrocarbon containing at least two condensed rings to produce a mesophase pitch in which the coupling polymerization constitutes at least 60% of the polymerization reactions, said polymerization being carried out with a weak Lewis acid and a polar solvent for said aromatic hydrocarbon, said solvent being non-reactive with said Lewis acid.

3. A method for producing a mesophase pitch comprising a polymerization reaction of an aromatic hydrocarbon containing at least two condensed rings to produce a mesophase pitch in which the coupling polymerization constitutes at least 60% of the polymerization reactions, said polymerization being carried out with a weak Lewis acid and a polar solvent for said aromatic hydrocarbon, said solvent being non-reactive with said Lewis acid.

4. The method of claim 3, further comprising the steps of removing inorganic components.

5. The method of claim 3, wherein said polymerization produces a product, further comprising the steps of removing inorganic compounds from said product and thermally treating said product to increase its mesophase content.

6. The method of claim 5, wherein the thermal treatment of said product includes sparging of said product.

7. The method of claim 3, wherein said weak Lewis acid comprises anhydrous $AlCl_3$ and a second component which is a weaker acid and tends to reduce the activity of said $AlCl_3$.

8. The method of claim 3, wherein said solvent is selected from the group consisting of o-dichlorobenzene, nitrobenzene, and trichlorobenzene.

9. The method of claim 3, wherein said weak Lewis acid comprises anhydrous $AlCl_3$ and anhydrous $CuCl_2$.

10. A mesophase pitch produced by the method of claim 3 having ellipsoidal molecules, having a stack height from about 20 Å to about 25 Å and an interlayer spacing less than about 3.50 Å.

11. A mesophase pitch produced by the method of claim 3 having ellipsoidal molecules and being capable of mixing uniformly with both rod-like and discotic nematic liquid crystals when said mesophase pitch has about 100% by weight mesophase content.

12. The method of claim 3, wherein said solvent has a boiling point higher than about 100° C.

* * * * *

UNITED STATES PATENT AND TRADEMARK OFFICE

CERTIFICATE OF CORRECTION

PATENT NO. : 4,457,828

DATED : July 3, 1984

INVENTOR(S) : Irwin C. Lewis

It is certified that error appears in the above-identified patent and that said Letters Patent is hereby corrected as shown below:

Col. 3, line 16, change "acording" to --according--

Col. 4, line 65, change "100°" to --100°C--

Col. 5, line 23, change "$AlCl_2$" to --$AlCl_3$--

Col. 9, line 44, change "has" to --had--

Col. 12, line 61, after "85%" insert --by weight--

Col. 14, line 48, change "100%" to --10%--

Signed and Sealed this

*Eighth* Day of *January 1985*

[SEAL]

*Attest:*

*Attesting Officer*

GERALD J. MOSSINGHOFF

*Commissioner of Patents and Trademarks*